US007913997B2

(12) United States Patent
Watanabe

(10) Patent No.: US 7,913,997 B2
(45) Date of Patent: Mar. 29, 2011

(54) SHEET FEEDING DEVICE, SHEET FEEDING CASSETTE USED FOR THE SAME, AND IMAGE FORMING APPARATUS

(75) Inventor: Kenichi Watanabe, Shinsiro (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 320 days.

(21) Appl. No.: 11/976,712

(22) Filed: Oct. 26, 2007

(65) Prior Publication Data

US 2008/0191407 A1 Aug. 14, 2008

(30) Foreign Application Priority Data

Feb. 14, 2007 (JP) ..... 2007-033139

(51) Int. Cl.
*B65H 3/34* (2006.01)

(52) U.S. Cl. ..... 271/167; 271/121; 271/126

(58) Field of Classification Search ..... 271/10.01, 271/18, 167, 121, 126
See application file for complete search history.

(56) References Cited

U.S. PATENT DOCUMENTS 3,687,448 A * 8/1972 Vora ..... 271/21
3,857,558 A * 12/1974 Patel ..... 271/22
5,058,877 A * 10/1991 Fujiwara et al. ..... 271/124
5,088,715 A * 2/1992 Shibata et al. ..... 271/9.09
5,183,248 A * 2/1993 Okada et al. ..... 271/127
5,316,285 A * 5/1994 Olson et al. ..... 271/122
5,437,444 A * 8/1995 Kawakami et al. ..... 271/22
5,626,334 A * 5/1997 Kondo et al. ..... 271/121
5,934,664 A * 8/1999 Murayama et al. ..... 271/118
5,951,003 A * 9/1999 Nojima et al. ..... 271/121
6,135,443 A * 10/2000 Yano ..... 271/121
6,158,733 A * 12/2000 Muraki ..... 271/127
6,305,682 B1 * 10/2001 Saito et al. ..... 271/10.11
6,318,716 B1 * 11/2001 Okuda ..... 271/121
(Continued)

FOREIGN PATENT DOCUMENTS

JP 6-18344 U 3/1994
(Continued)

OTHER PUBLICATIONS

Notification of Reason(s) for Refusal in JP 2007-033139 dated Dec. 24, 2008, and an English Translation thereof.

*Primary Examiner* — Stefanos Karmis
*Assistant Examiner* — Howard Sanders
(74) *Attorney, Agent, or Firm* — Buchanan Ingersoll & Rooney PC

(57) ABSTRACT

A sheet feeding device comprises a pick roller; a push-up board; a first friction member located in a position on the push-up board opposed to the pick roller with the sheet bundle interposed therebetween; and a second friction member located in a position on the push-up board upstream in a sheet transferring direction and not opposed to the pick roller. In the sheet feeding device, the second friction member has a most protruding part which protrudes to the sheet bundle more than a sheet bundle side surface of the first friction member, and a dynamic friction coefficient of the second friction member to the sheet is larger than that of the first friction member and smaller than that of the pick roller. Accordingly, double-paper feeding can be prevented and even the last one sheet can be fed regardless types of sheets.

15 Claims, 9 Drawing Sheets

U.S. PATENT DOCUMENTS

| | | | | |
|---|---|---|---|---|
| 6,337,751 | B1 * | 1/2002 | Kimizuka | 358/498 |
| 6,371,477 | B1 * | 4/2002 | Lin | 271/121 |
| 6,485,014 | B1 * | 11/2002 | Lin | 271/121 |
| 6,672,580 | B2 * | 1/2004 | Shibata et al. | 271/124 |
| 2004/0169326 | A1 | 9/2004 | Nakano | |

FOREIGN PATENT DOCUMENTS

| | | |
|---|---|---|
| JP | 08-012115 | 1/1996 |
| JP | 2003-160251 | 6/2003 |
| JP | 2004-210434 A | 7/2004 |
| JP | 2004-269148 | 9/2004 |

* cited by examiner

SHEET FEEDING DEVICE, SHEET FEEDING CASSETTE USED FOR THE SAME, AND IMAGE FORMING APPARATUS

CROSS-REFERENCE TO RELATED APPLICATIONS

This application is based upon and claims the benefit of priority from the prior Japanese Patent Application No. 2007-033139 filed on Feb. 14, 2007, the entire contents of which are incorporated herein by reference.

BACKGROUND OF THE INVENTION

1. Field of the Invention

The present invention relates to an image forming apparatus such as a copier and a printer, a sheet feeding device that feeds a sheet to the image forming apparatus, and a sheet feeding cassette that is removably attached to the sheet feeding device. More particularly, the present invention relates to an image forming apparatus, a sheet feeding device for feeding sheets stacked in a sheet feeding cassette to the image forming apparatus one by one, and a sheet feeding cassette used for such a sheet feeding device.

2. Description of Related Art

Image forming apparatuses such as copiers and printers include a sheet feeding device that feeds sheets for imaging to an image forming part. In general, sheet feeding devices feed sheets from a sheet bundle stacked in a sheet feeding cassette that is removably attached to the sheet feeding device, by delivering sheets one after another by a sheet feeding roller and the like. Among these devices, such a sheet feeding device is known that includes a push-up board for pushing up the stacked sheets in the sheet feeding cassette and thereby bringing the uppermost sheet into contact with a delivery member such as a pick roller.

In such a sheet feeding device, stability is demanded in feeding sheets, regardless of types of sheets or the number of sheets. To meet the demand, many sheet feeding devices employ a friction member at a position opposed to the pick roller to apply friction resistance to the lower layer of a sheet bundle. As the friction member, there have been devised friction members having various shapes or friction coefficients (for example, see Japanese Unexamined Patent Publication No. 2004-210434 and Japanese Unexamined Utility Model Publication No. 6(1994)-18344). In these known publications, it is stated that it is possible to adjust friction force applied to the sheet or contact angle of the sheet and the delivery member so that double-paper feeding can be prevented.

SUMMARY OF THE INVENTION

However, some types of sheets have on their edges slight cut-off burrs, which are likely to bring adjacent sheets in a sheet bundle into engaged with each other, causing the sheets to be hard to be separated. Thus, the aforementioned various sheet feeding devices may not probably prevent double-paper feeding, especially, when few sheets are left. Use of friction member having a large dynamic friction coefficient will be effective for preventing double-paper feeding, however, that is not enough to solve other problems such as misfeeding the last one to few sheets or causing wrinkles in the sheets.

The present invention has been made to solve the above problems in the conventional sheet feeding devices. More specifically, the invention has an object to provide a sheet feeding device that can prevent double-paper feeding and feed even the last one sheet regardless types of sheets, a sheet feeding cassette used for the same, and an image forming apparatus.

In order to achieve the above object, there is provided a sheet feeding device comprising a pick roller to be brought into contact with an uppermost sheet in a sheet bundle for drawing out the uppermost sheet and a push-up board for pushing up the sheet bundle to the pick roller, wherein the sheet feeding device further comprises: a first friction member located in a position at push-up board side opposed to the pick roller with the sheet bundle interposed therebetween so as to be brought into contact with a lowermost sheet in the sheet bundle; and a second friction member located in a position at push-up board side upstream in a sheet transferring direction and not opposed to the pick roller so as to be brought into contact with the lowermost sheet in the sheet bundle, and wherein the second friction member has a most protruding part which protrudes to the sheet bundle more than a sheet bundle side surface of the first friction member; and a dynamic friction coefficient of the second friction member to the sheet is larger than a dynamic friction coefficient of the first friction member to the sheet and smaller than a dynamic friction coefficient of the pick roller to the sheet.

According to the sheet feeding device of this invention, the sheet bundle is pushed up to the pick roller. In this time, the lowermost sheet in the sheet bundle is brought into contact with the first friction member and the second friction member. Further, the most protruding part in the second friction member protrudes to the sheet bundle side more than the sheet bundle side surface of the first friction member. Thus, the lowermost sheet in a sheet bundle consisting of certain number of sheets can be reliably brought into contact with the second friction member by own weight of the sheet bundle. In this time, since the dynamic friction coefficient of the second friction member to sheets is larger than that of the first friction member and smaller than that of the pick roller, then the sheet in contact with the second friction member is not transferred in a bundle. Therefore, double-paper feeding is prevented regardless of types of sheets. On the other hand, an extremely thin sheet bundle is lightweight and is likely to receive less friction force from the second friction member not opposed to the pick roller so that even the last one sheet can be fed.

In order to achieve the above object, there is further provided a sheet feeding cassette to be used for an image forming apparatus which has a pick roller, the sheet feeding cassette comprising a push-up board for pushing up a sheet bundle to the pick roller, wherein the sheet feeding cassette further comprises: a first friction member located in a position at push-up board side opposed to the pick roller with the sheet bundle interposed therebetween so as to be brought into contact with a lowermost sheet in the sheet bundle; and a second friction member located in a position at push-up board side upstream in a sheet transferring direction and not opposed to the pick roller so as to be brought into contact with the lowermost sheet in the sheet bundle, and wherein the second friction member has a most protruding part which protrudes to the sheet bundle more than a sheet bundle side surface of the first friction member; and a dynamic friction coefficient of the second friction member to the sheet is larger than a dynamic friction coefficient of the first friction member to the sheet and smaller than a dynamic friction coefficient of the pick roller to the sheet.

In order to achieve the above object, there is further provided an image forming apparatus comprising an image forming part, a pick roller to be brought into contact with an uppermost sheet in a sheet bundle for drawing out the uppermost sheet to the image forming part, and a push-up board for pushing up the sheet bundle to the pick roller, wherein the image forming apparatus further comprises: a first friction member located in a position at push-up board side opposed to the pick roller with the sheet bundle interposed therebetween so as to be brought into contact with a lowermost sheet in the sheet bundle; and a second friction member located in a position at push-up board side upstream in a sheet transferring direction and not opposed to the pick roller so as to be brought into contact with the lowermost sheet in the sheet bundle, and wherein the second friction member has a most protruding part which protrudes to the sheet bundle more than a sheet bundle side surface of the first friction member; and a dynamic friction coefficient of the second friction member to the sheet is larger than a dynamic friction coefficient of the first friction member to the sheet and smaller than a dynamic friction coefficient of the pick roller to the sheet.

According to the sheet feeding device, the sheet feeding cassette used for the same, and the image forming apparatus, double-paper feeding can be prevented and even the last one sheet can be fed.

DETAILED DESCRIPTION OF THE PREFERRED EMBODIMENTS

Referring now to the accompanying drawings, preferred embodiments of the invention will be hereinafter described in detail. The present embodiment relates to a sheet feeding device for feeding sheets one by one to an image forming apparatus of a color printer.

Figure 1:
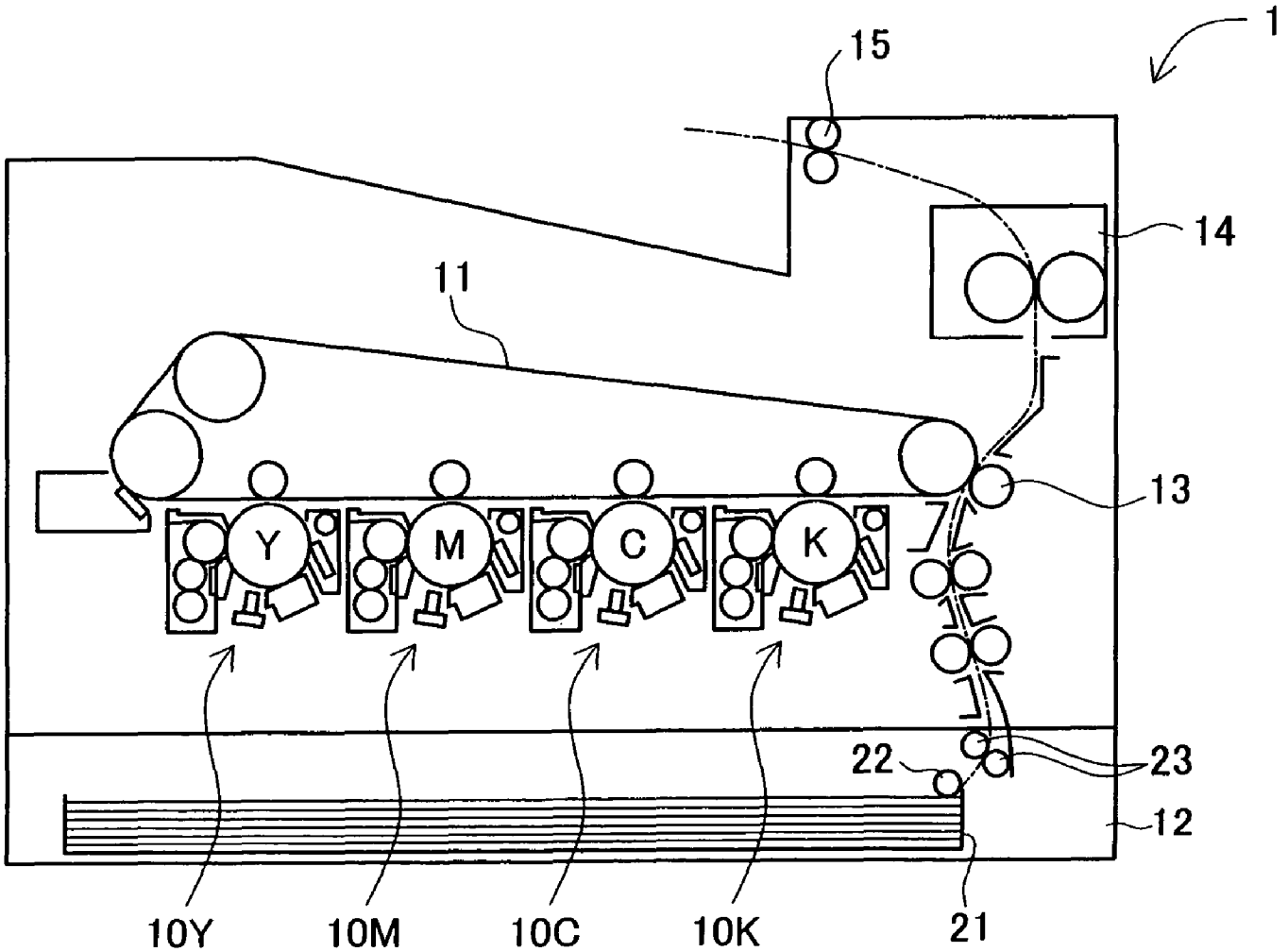
FIG. 1 is a cross-sectional view illustrating a schematic structure of an image forming apparatus of the present embodiment.

As shown in FIG. 1, a color printer 1 of this embodiment is what is called a tandem-type image forming apparatus. The color printer 1 is provided with image forming parts 10Y, 10M, 10C and 10K for respective colors arranged in a line along an intermediate transfer belt 11, and a sheet feeding device 12 located at the bottom of the color printer 1. Also, the color printer 1 is provided with a secondary transfer device 13, fixing device 14, and a sheet ejecting roller 15.

In forming images by the color printer 1, image forming processes are performed for image forming parts 10Y, 10M, 10C, and 10K based on image data. Next, toner images of the respective colors are formed and superimposed on the intermediate transfer belt 11. The superimposed toner images are transferred onto a sheet fed via the sheet feeding device 12 by the secondary transfer device 13. Then, the transferred toner images are fixed by the fixing device 14. Finally, the sheet of paper with the fixed toner images is ejected to outside the printer via the paper ejecting roller 15.

Figure 2:
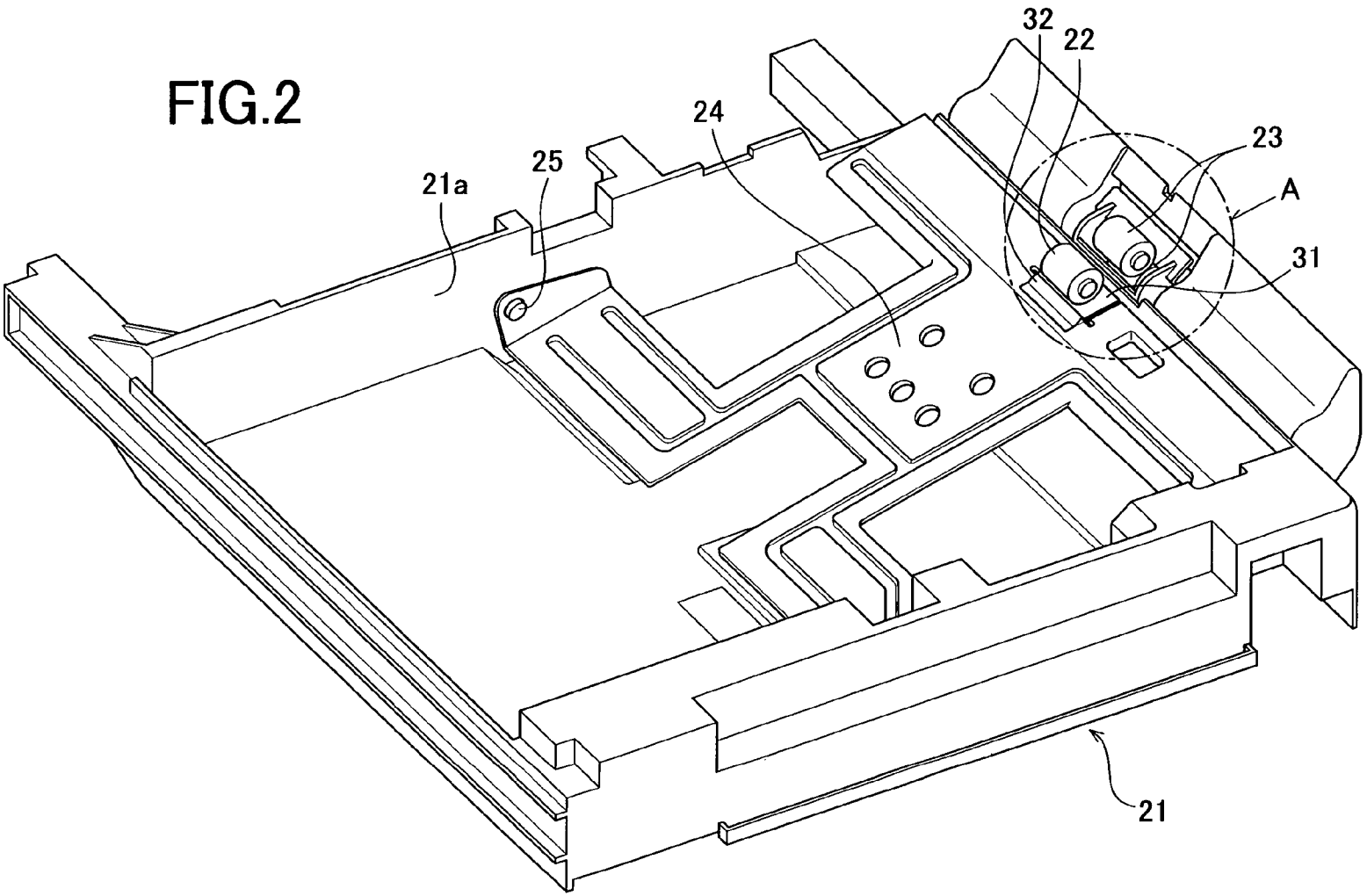
FIG. 2 is a perspective view of a sheet feeding device.
Figure 3:
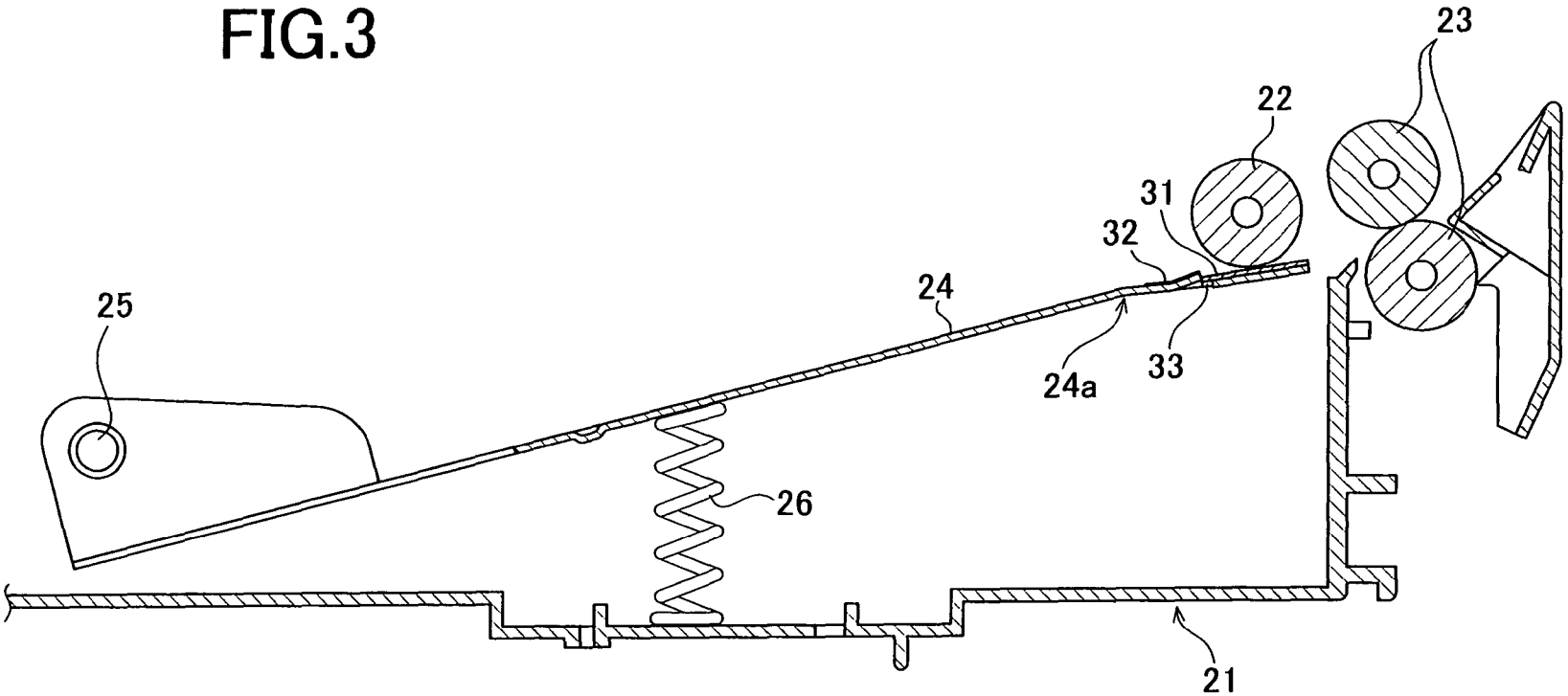
FIG. 3 is a cross-sectional view of the sheet feeding device.

As shown in FIGS. 2 and 3, the sheet feeding device 12 has a sheet feeding cassette 21, a pick roller 22, and a sheet feeding roller pair 23. The pick roller 22 and the sheet feeding pair 23 are not provided internally in the tape cassette 21 but provided in the main body of the color printer 1. The sheet feeding cassette 21 is provided with a push-up board 24 which pushes up sheets from the lower side, attached thereto. The push-up board 24 is a substantially "H" shaped thin plate and is attached to an inner wall 21*a* of the sheet feeding cassette 21 so as to be rotatable around a rotating shaft 25. Not shown in FIG. 2, the push-up board 24 is also rotatably attached to the side wall of the sheet feeding cassette 21 at the front side in the figure, in the same axial direction as the rotating shaft 25.

Further, the sheet feeding cassette 21 is provided with an urging member 26 (see FIG. 3) on its bottom surface 21*b*, and thereby a part of the push-up board 24 near its center is brought to be urged in an upward direction in the figure. Accordingly, the push-up board 24 rotates around the rotating shaft 25 on the left side in FIG. 3 in such a manner that the right side in the figure is urged in the upward direction, that is, the push-up board 24 is urged in a counterclockwise direction in the figure. When sheets are not stacked in the sheet feeding cassette 21, the right end part of the push-up board 24 in the figure is lifted upward as shown in FIG. 3 so that the upper surface of the push-up board 24 is brought into contact with the pick roller 22.

The pick roller 22 and the sheet feeding roller pair 23 are attached to the main body of the color printer 1 so as to receive a rotational drive. Only the rollers are depicted in the figure for explanation, however, rotating shafts for these rollers are fixed at the predetermined positions in the main body of the color printer 1. When the sheet feeding cassette 21 is attached to the color printer 1, the sheet feeding device 12 is brought into the state as shown in FIGS. 2 and 3. In this embodiment, the pick roller 22 and the sheet feeding roller pairs 23 have much shorter lengths in their depth direction in FIG. 3 compared with the width of the sheet feeding cassette 21 and are arranged only in the center of the depth direction in the figure.

In loading sheets in the sheet feeding cassette 21, the push-up board 24 is pushed down against the urging force of the urging member 26, and sheets are placed thereon. The push-up board 24 pushes up the sheets by urging force of the urging member 26 in the upward direction in the figure. Then, the uppermost sheet is brought into contact with the pick roller 22. When the pick roller 22 is driven to rotate in the counterclockwise direction in FIG. 3, the uppermost sheet is drawn out by the pick roller 22 and pushed out to the feed roller 23 pair.

As operation of sheet feeding goes like as described above, hereinafter the horizontal direction in FIG. 3 is referred to as a sheet transferring direction, the right side of the figure is referred to as a front side, and the left side is referred to as a back side. The front side corresponds to downstream in the sheet transferring direction and the back side corresponds to upstream in the sheet transferring direction. Also, the depth direction in the figure is referred to as a sheet width direction. The pick roller 22 side, which is in a direction perpendicular to the push-up board 24 (or a height direction), is referred to as an upper side, and the bottom surface 21*b* side of the sheet feeding cassette 21 is referred to as a lower side. When sheets are placed on the push-up board 24, the upper side corresponds to a sheet bundle side.

As shown in FIG. 3, the push-up board 24 is slightly folded at a place 24*a* back side to the contact position with the pick roller 22 over the entire width of the push-up board 24 in the sheet width direction. More particularly, the part of the push-up board 24 where the fold line 24*a* is provided is in a peak-like shape along the fold line 24*a*. This shape brings loaded sheets to be slightly bent in the sheet transferring direction so as to prevent a warpage of sheets in the sheet width direction. The folded part is shown with exaggeration in the figure for convenience of explanation.

Figure 4:
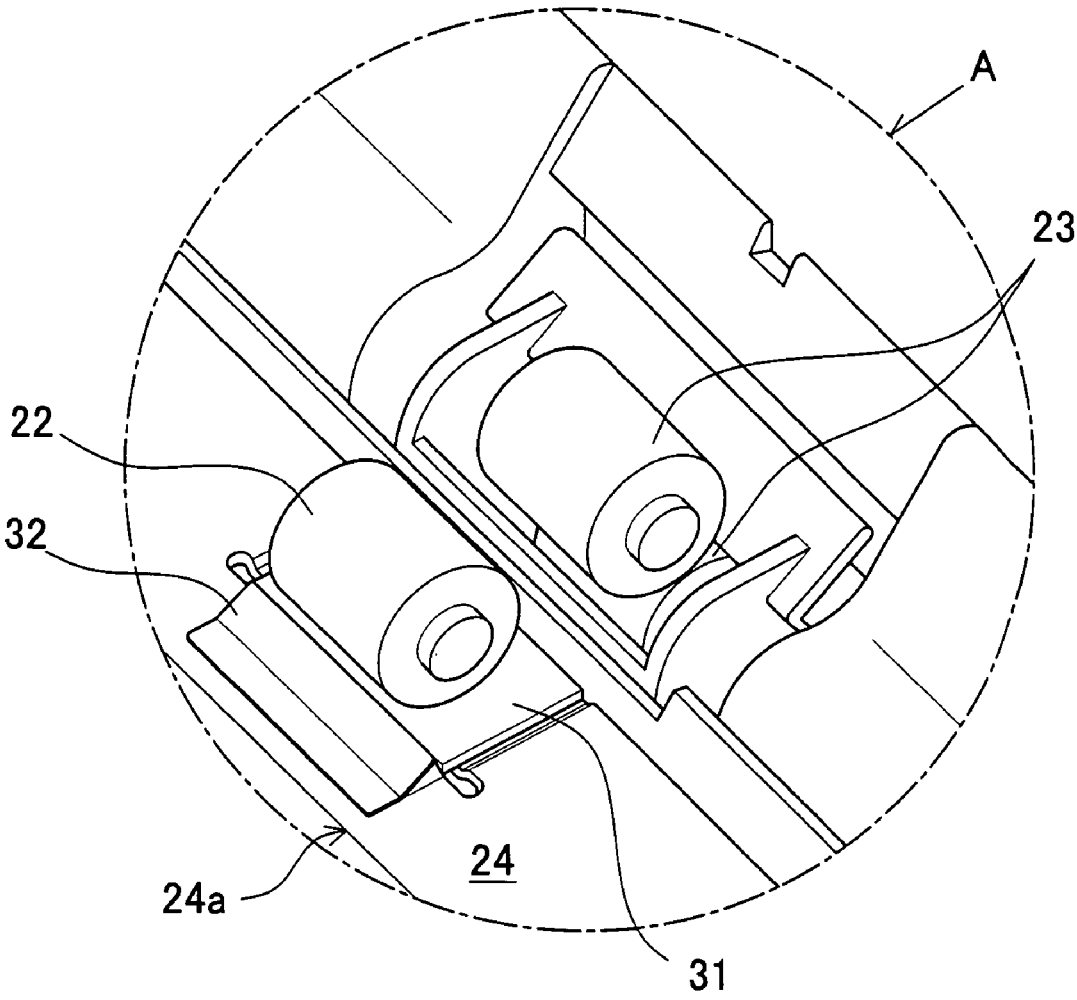
FIG. 4 is a perspective view of a pick roller and an area therearound.
Figure 5:
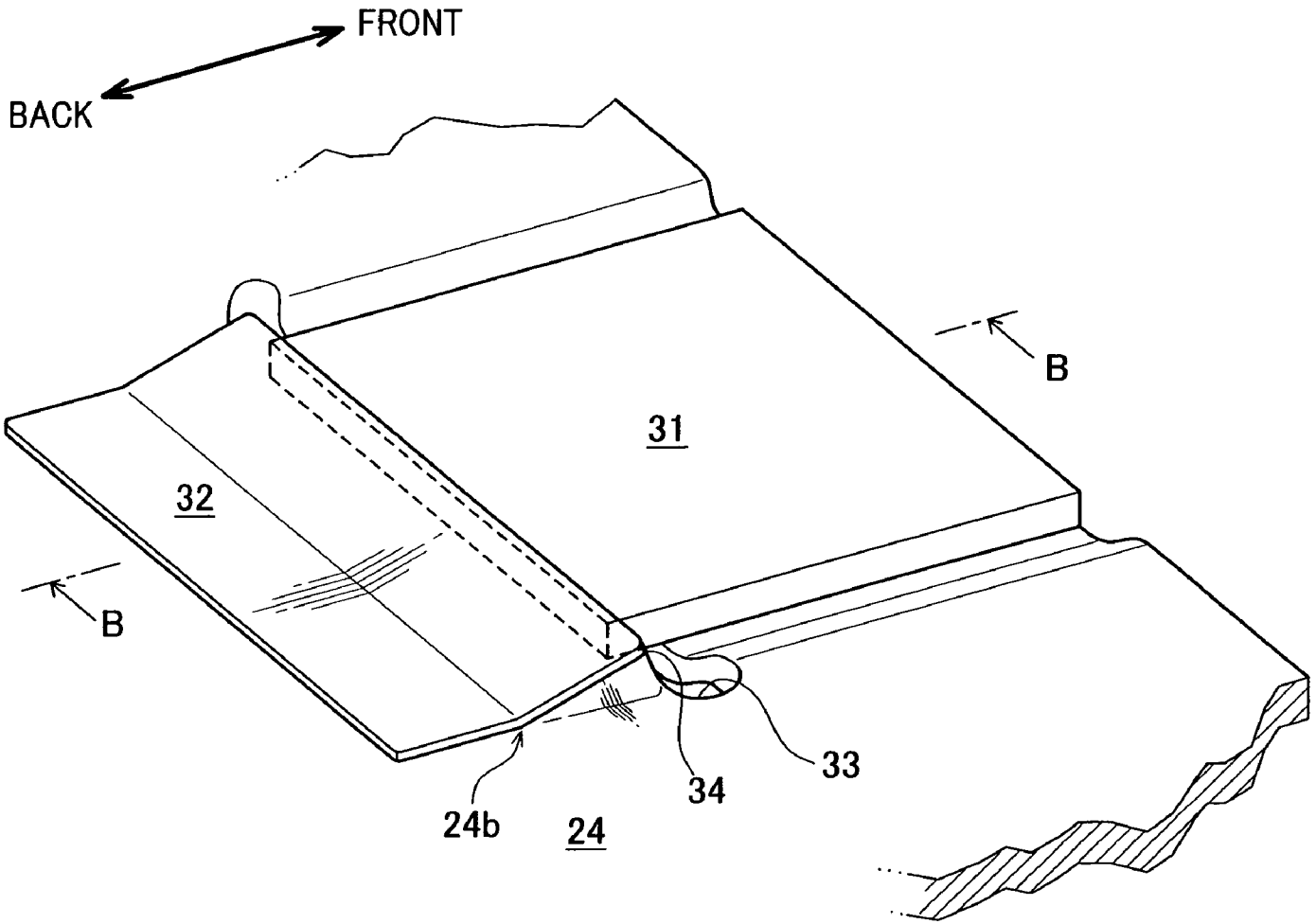
FIG. 5 is a plan view of a first friction member and a second friction member, and an area therearound.
Figure 6:
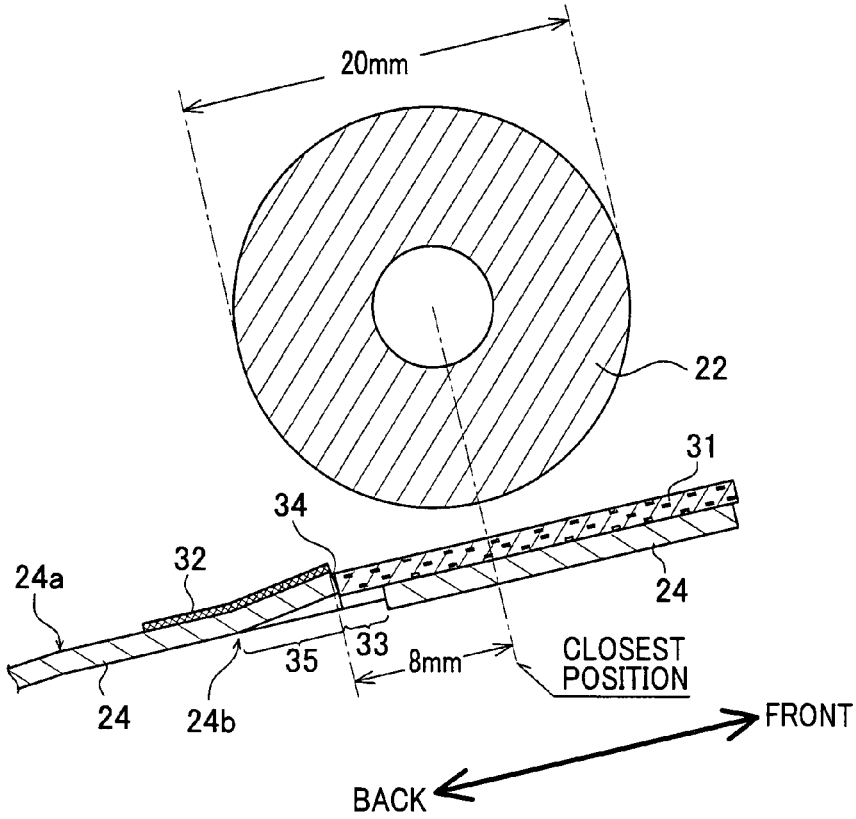
FIG. 6 is a vertical-sectional view of the first friction member and the second friction member, and the area therearound.

In the present embodiment, as shown in FIGS. 2 and 3, a first friction member 31 is attached within the area on the upper surface of the push-up board 24 covering the contact position with the pick roller 22. A second friction member 32 is attached at a back-side position of the first friction member 31 in the sheet transferring direction. The second friction member 32 is adhered to the position which does not get contact with the pick roller 22. Here, adjacent area A, which is close to the first friction member 31 and the second friction member 32, is shown in FIG. 4 in an enlarged manner. In FIG. 4, the reference 24*a* represents the fold line of the peak-like shape. Further in area A, the area of the push-up board 24 side except for the pick roller 22 and the sheet feeding roller pair 23 is shown in FIG. 5. Then, a cross-sectional view of FIG. 5 taken along B-B line is shown in FIG. 6. In FIG. 6, the pick roller 22 is arranged slightly apart from the push-up board 24 for convenience of comparison of positional relationship of parts.

As shown in FIG. 5, the push-up board 24 is provided with a slit 33. The front side of the slit 33 in the push-up board 24 where the first friction member 31 is located is lowered than its left and right side. This forms a slightly concaved shape in the part of the push-up board 24 where the first friction member 31 is to be adhered, thereby avoiding the part from projecting significantly compared with the other part of the push-up board 24 in the sheet width direction. Further, the length of the first friction member 31 in the sheet width direction is slightly longer than the length of the pick roller 22 in the axial direction. Accordingly, the part where the pick roller 22 get contact with and the area where the pressing force of the pick roller 22 works via sheets can be entirely covered with the first friction member 31.

On the other hand, the back side of the slit 33 in the push-up board 24 is convex compared with its front side. As shown in FIG. 6, a bevel part 35 which is warped upward slightly toward the back end part 34 is formed at the back side from a back end part 34 of the slit 33. The back end of the bevel part 35 forms a fold part 24*b* which is in a concaved shape upward. The second friction member 32 is adhered to cover the back side of the back end part 34 of the slit 33 on the upper surface of the push-up board 24. The second friction member 32 is provided to cover at least back side of the fold part 24*b*.

Figure 7:
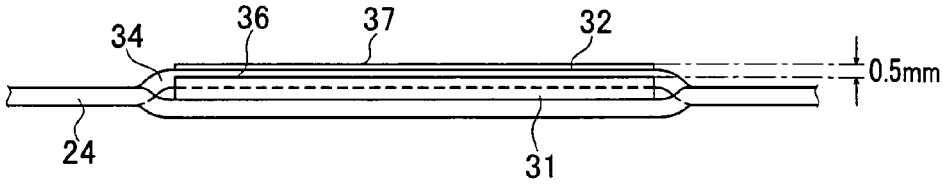
FIG. 7 is a horizontal sectional view of the first friction member and the second friction member, and the area therearound.

As shown in FIG. 7, an upper surface 36 of the first friction member 31 is as high as the back end part 34 of the slit 33 or slightly lower. FIG. 7 shows the push-up board 24 seen from the front side in the sheet transferring direction. Since the second friction member 32 is adhered to cover the back end part 34 of the slit 33, an upper surface 37 of the adhered part is higher than the upper surface 36 of the first friction member 31. That is, the second friction member 32 is arranged so that the highest part of the upper surface 37 is higher than the upper surface 36 of the first friction member 31. Owing to this arrangement, the lowermost sheet placed on the push-up board 24 is reliably brought into contact with the second friction member 32.

In the present embodiment, the front end part of the second friction member 32 is located at the back end part 34 and the upper surface 37 of the front end part is raised by approximately 0.5 mm with respect to the upper surface 36 of the first friction member 31. The height difference between the upper surface 37 and the upper surface 36 preferably falls within 1.5 mm. The highest part of the upper surface 37 may not be necessarily located at the back end part 34 of the slit 33.

Further, as shown in FIG. 6, the front end part of the second friction member 32 is located approximately 8 mm backward the closest position between the pick roller 22 and the first friction member 31. That is, the front end part of the second friction member 32 is located backward from the closest position between the pick roller 22 and the first friction member 31 by a distance not exceeding 10 mm. Here, the pick roller 22 has a diameter of 20 mm, so the distance 10 mm corresponds to a radius of it, approximately. When a roller having larger diameter is used as the pick roller 22, the second friction member 32 may be located slightly further from the pick roller 22.

Due to the arrangement described above, when sheets are not loaded and the pick roller 22 and the upper surface 36 of the first friction member 31 are brought into contact by a pressing force of the urging member 26, the pick roller 22 and the second friction member 32 are unlikely to get contact with each other. However, when a sheet bundle with some extent of thickness is loaded, the lowermost sheet will be pressed upward with the second friction member 32 by the urging force of the urging member 26.

The length of the second friction member 32 in the sheet width direction may be almost the same length of the first friction member 31 in the sheet width direction, which is slightly longer than the length of the pick roller 22 in the axial direction. Further, as shown in FIG. 7, the length of the second friction member 32 is preferably such that the second friction member 32 is not contact with the bent parts at both ends of the slit 33. Such a length will avoid the second friction member 32 from peeling off the push-up board 24. The front end part of the second friction member 32 may not necessarily be tightly fit to the back end part 34 of the slit 33. It will not be a problem that the front end part of the second friction member 32 is off back or forth of the back end part 34 to some extent. This brings an efficient workability in fabricating products.

Figure 8:
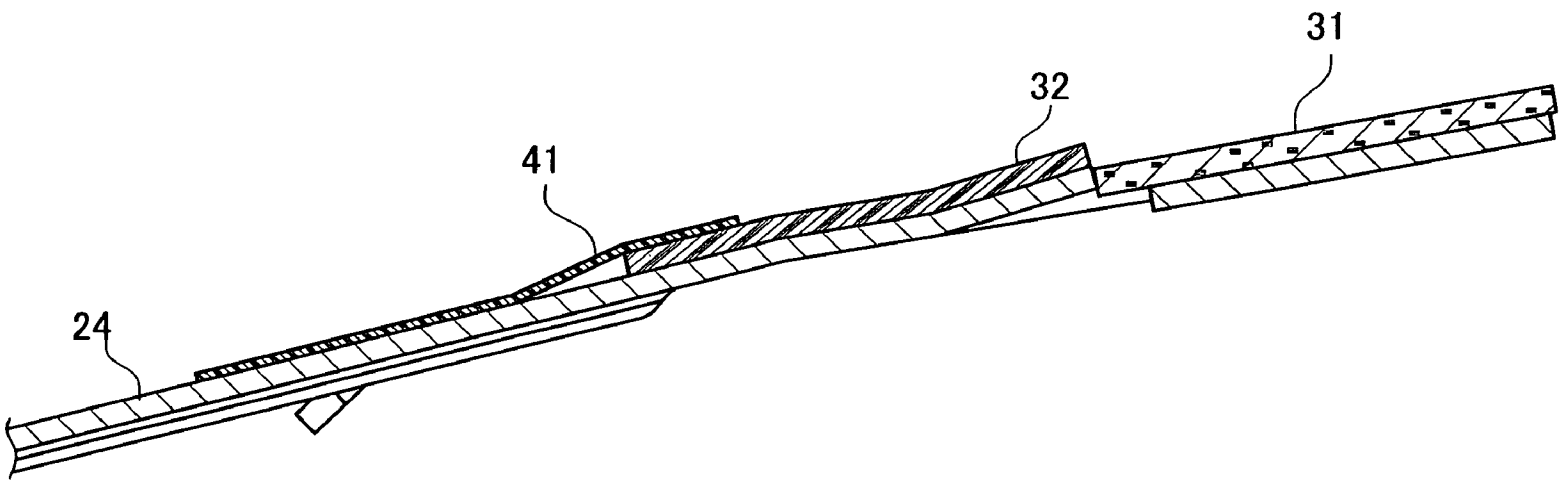
FIG. 8 is a vertical-sectional view of the first friction member and the second friction member, and the area therearound.
Figure 9:
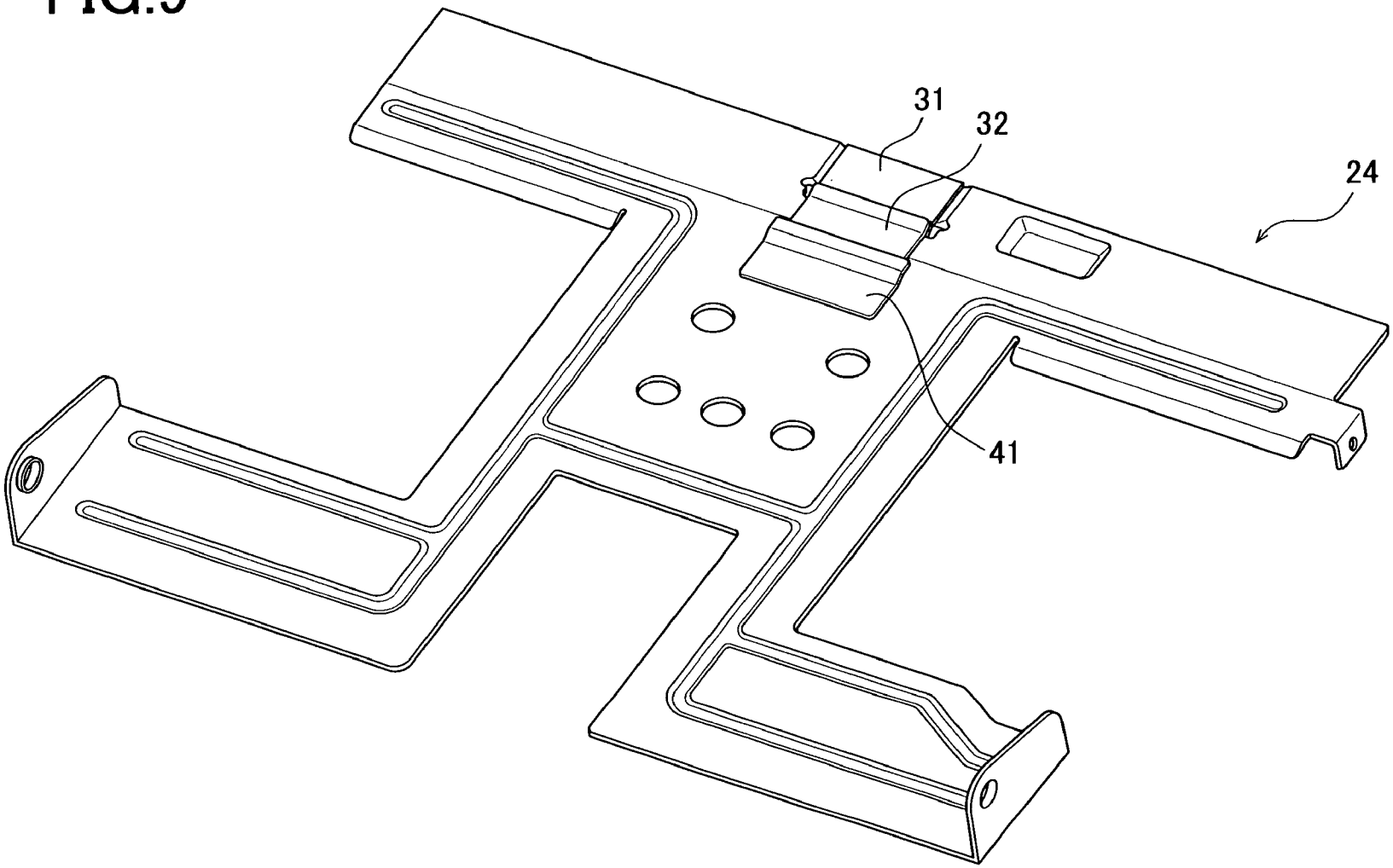
FIG. 9 is a perspective view of a push-up board.

Incidentally, use of members having a large thickness or a long length in the sheet transferring direction as the second friction member 32 will bring the end of new sheets to be loaded into contact with the back end of the second friction member 32, so that it is likely to disturb placing sheets. In that case, a thin film 41 with a thickness of 0.15 mm or thinner may be used to cover the back end part of the second friction member 32 as shown in FIGS. 8 and 9. For example, PET films with a thickness of 0.1 mm can be used as the film 41.

Next, preferable materials for the first friction member 31 and the second friction member 32 will be explained. It is advisable to employ such materials that a dynamic friction coefficient $\mu 1$ of the first friction member 31 to a sheet and a dynamic friction coefficient $\mu 2$ of the second friction member 32 to the sheet satisfy both of the following expression 1 and expression 2. In the expression 1, $\mu 0$ indicates a dynamic friction coefficient between commonly used sheets and $\mu 3$ indicates a dynamic friction coefficient of the surface of the pick roller 22 to a sheet. The dynamic friction coefficients mentioned here can be measured by commercially available standard devices for measuring dynamic friction coefficients.

$$\mu 0 \approx \mu 1 \quad \text{(Expression 1)}$$

$$\mu 1 < \mu 2 < \mu 3 \quad \text{(Expression 2)}$$

The dynamic friction coefficient μ0 between sheets is generally about 0.6, though it varies depending on types of sheets or use conditions. To draw out a sheet having such a dynamic friction coefficient μ0 surely, such members that have a sufficient dynamic friction coefficient to the sheet are used for the surface of the pick roller 22. In this embodiment, a member with a dynamic friction coefficient of 1.2 or more has been used. Even when there are cut-off burrs in the edges of sheets and some of the adjacent sheets are in a meshed state, necessary force for moving the uppermost sheet corresponds to a dynamic friction coefficient of approximately 1.0. The dynamic friction coefficient of the pick roller 22 to sheets is set larger than the dynamic friction coefficient between such sheets. Further, the dynamic friction coefficient of the feed roller pair 23 to sheets is set to the same as the pick roller 22.

The first friction member 31 which satisfies the expressions 1 and 2 mentioned above preferably has a dynamic friction coefficient μ1 of 0.55 to 0.65 to sheets, approximately. The dynamic friction coefficient μ2 of second friction member 32 is preferably in a range from 0.65 to 1.2. To meet such conditions, for example, a cork board with a thickness of about 1.2 mm can be used as the first friction member 31, and a polyurethane sheet with a thickness of about 0.1 to 1.5 mm can be used as the second friction member 32, each of which being attached with a double-sided adhesive tape. Cork boards with a dynamic friction coefficient of about 0.6 to sheets are easily, available. Also, polyurethane sheets with a dynamic friction coefficient of about 0.7 to 0.8 to sheets are easily available. These members satisfy the preferred relationship of the dynamic friction coefficients indicated by the expressions 1 and 2.

While friction members as described above are used, it is possible to employ the push-up board 24 of which surface has a dynamic friction coefficient to sheets smaller than the dynamic friction coefficient μ0. For example, there are wide variations among commercially available steel plates in dynamic friction coefficients to sheets, depending on manufacturers. Since this embodiment comprises the first friction member 31 and the second friction member 32, it is not necessary to be concerned about a dynamic friction coefficient of the push-up board 24. Therefore, any steel plates can be used as the push-up board 24. Moreover, particularly slippery materials with a dynamic friction coefficient of 0.16 or less can be used as the push-up board 24.

Figure 10:
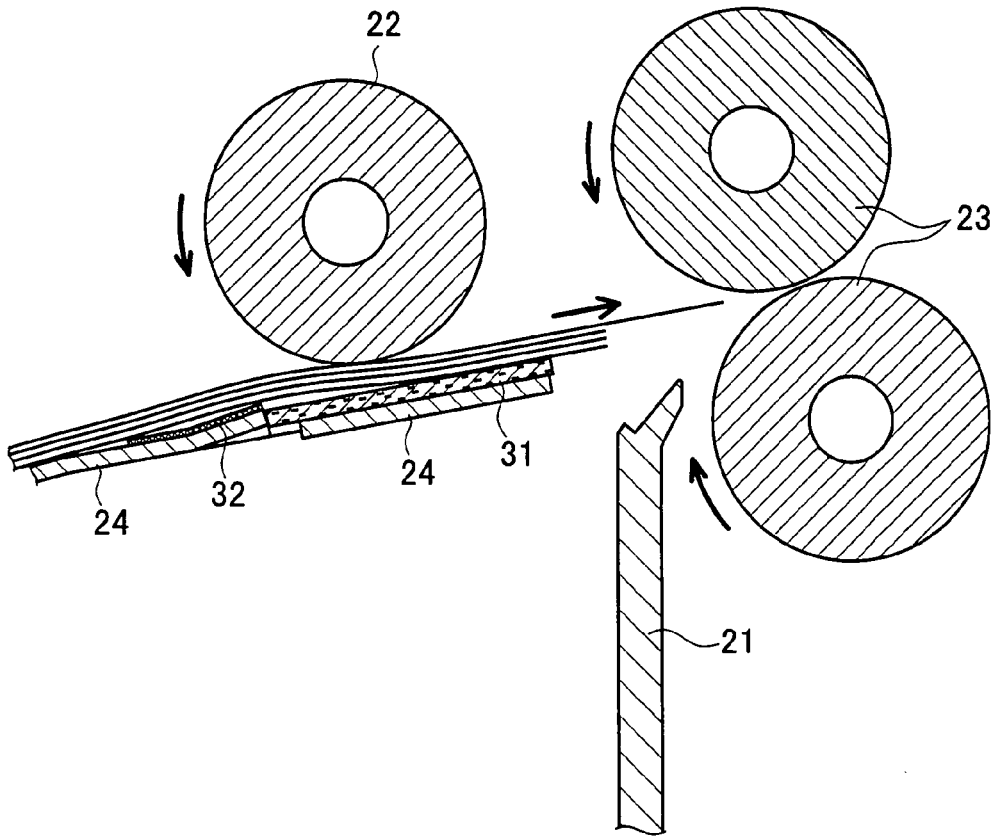
FIG. 10 is a partial cross-sectional view of the sheet feeding device illustrating how sheets are fed by the sheet feeding device.

Next, how the sheet feeding device 12 of this embodiment feeds sheets will be explained. When the sheet feeding cassette 21 loaded with sheets is installed in the main body of the color printer 1, the whole sheets are pushed up by the push-up board 24 and thereby the uppermost sheet is brought into contact with the pick roller 22. At the same time, the lowermost sheet is brought into contact with the first friction member 31 and the second friction member 32. Then, as indicated by the arrow in FIG. 10, the pick roller 22 and the sheet feeding roller pair 23 are driven to rotate and thereby only the uppermost sheet is ejected.

When a large number of sheets are loaded, a great thickness of the sheet bundle sandwiched between the first friction member 31 and the pick roller 22 compresses the urging member 26 highly, so that the sheet bundle receives a strong pressing force by the push-up board 24. At the same time, a heavy load is applied to the lowermost sheet by own weight of the sheet bundle. Accordingly, a large friction force is generated between the lowermost sheet and the first friction member 31, and also between the sheets. Thus, the sheet bundle stands firmly where it is placed. The dynamic friction coefficient of the pick roller 22 to the sheet is set larger than the coefficient between the sheets as described above, so that only the uppermost sheet is drawn out from the sheet bundle by rotation of the pick roller 22.

When the loaded sheets are decreasing to an extent of several sheets to twenty sheets, the thinner sheet bundle sandwiched between the pick roller 22 and the first friction member makes the compression rate of the urging member 26 slightly smaller. However, the sheet bundle has a sufficient thickness even in that case, so that the lowermost sheet is surely brought into contact with the upper surface 37 by the pressing force of the pick roller 22 and own weight of the sheet bundle. Since the dynamic friction coefficient of the second friction member 32 to the sheet is set to the value as described above, the friction between the lower most sheet and the second friction member 32 is larger than the friction between the sheets. Thus, rotation of the pick roller 22 does not draw out the whole sheet bundle at once and only the uppermost sheet or a few sheets can be separated from the sheet bundle to be drawn out. In this embodiment, even when a few sheets are drawn out at once by the pick roller 22, the sheet feeding roller pair 23 can separate one sheet from the other sheets.

Further, when the loaded sheets are decreasing to an extent of one sheet to a few sheets, own weight of the sheets becomes very light. In addition, since the pick roller 22 does not press the sheets against the second friction member 32 directly, the lowermost sheet only touches the second friction member 32 slightly. Accordingly, the friction between the lowermost sheet and the second friction member 32 becomes extremely small, causing practically no friction that would be no resistance to sheet transfer. This allows the pick roller 22 to pick out the sheets more effectively and thereby even a remaining few sheets can be surely drawn out. In this embodiment, even when a few sheets are drawn out at once by pick roller 22, the sheet feeding roller pair 23 can separate one sheet from the other sheets. Also, even a single sheet loaded can be surely transferred.

Here, the result of an evaluation experiment on sheet feeding by the inventor will be indicated. In this experiment, the device of example 1 comprises both the first friction member 31 and the second friction member 32 and the comparative example 1 is an equivalent of example 1 except that it does not include the second friction member 32. Next, the device of example 1, which has undergone image forming operations of 1,000,000 sheets worth, was used in example 2. A sheet feeding cassette and a pick roller of the bizhub C352 produced by Konica Minolta Business Technologies, Inc. are used as a testing machine, of which push-up board was provided with the second friction member 32. In this experiment, the inventor checked the maximum number of sheets transferred in a bundle to the sheet feeding roller pair. Also, the number of occurrences of jamming was observed. The dynamic friction coefficients of the members used in this experiment to sheets are indicated as below.

First friction member: 0.6

Second friction member: 0.8

Pick roller: 1.2

As sheets for testing, sheet A with a smaller dynamic friction coefficient, sheet B with an intermediate level, and sheet C with a larger level were used. In particular, more cut-off burs are likely to occur in the edges of sheets C than in the other sheets, causing an extremely larger friction between the sheets. In using any sheets, the sheets were placed in the following manners. It is to be noted that sheets were loaded in a bundle of about fifty sheets without any preparation such as separation and in the as-unpacked condition.

Top-1: placing the sheets as they are unpacked.

Top-2: placing the sheets in a reversed manner in front-back direction.

Bot-1: placing the sheets in a reversed manner in top-bottom direction.

Bot-2 placing the sheets in a reversed manner in both front-back and top-bottom directions.

Additionally, the test was carried out under a condition with low temperature and humidity at a temperature of 10° C. and a humidity of 15%, where sheets tend to be so hard as to cause double-paper feeding. It had been already known that the sheet feeding roller pair of the testing machine could almost certainly separate sheets which were transferred in a bundle of up to about ten sheets. The test was conducted using two types of push-up boards 24. One of the push-up boards 24 has a dynamic friction coefficient of 0.15 and the other one has a coefficient of 0.25. In either case, the results of the tests were almost the same. Here, the result of the experiment using a push-up board 24 with a dynamic friction coefficient of 0.15 is indicated in Table 1.

TABLE 1

| | Types of sheets | Maximum number of fed sheets | | | | Number of occurrences of jamming |
|---|---|---|---|---|---|---|
| | | Top-1 | Top-2 | Bot-1 | Bot-2 | |
| Example 1 | Sheet A | 0 | 4 | 2 | 3 | 0 |
| | Sheet B | 1 | 1 | 0 | 0 | 0 |
| | Sheet C | 0 | 2 | 0 | 1 | 0 |
| Example 2 | Sheet A | 3 | 3 | 3 | 3 | 0 |
| | Sheet B | 1 | 3 | 1 | 1 | 0 |
| | Sheet C | 0 | 5 | 2 | 4 | 0 |
| Comparative Example 1 | Sheet A | 19 | 28 | 23 | 25 | 0 |
| | Sheet B | 20 | 20 | 17 | 20 | 2 |
| | Sheet C | 36 | 24 | 16 | 15 | 3 |

As can be seen from the above table, the number of sheets fed at one time in any cases in examples 1 and 2 was five sheets at the maximum. In addition, jamming did not occur in both of the examples in any manners of loading sheets. On the other hand, about fifteen to thirty sheets were fed at a time in the comparative example 1. Also, jamming occurred in the cases of using sheets B and C. These results show that the embodiment brings the favorable effect. According to the observation by the inventor, the sheets loaded in the comparative example 1 were pressed to the front inner wall of the sheet feeding cassette 21 while the sheets loaded in examples 1 and 2 were tightly held where they were loaded first.

Further, the inventor conducted the same test as above using the same testing machine under a condition with high temperature and humidity at a temperature of 30° C. and humidity of 85%, where sheets tend to be soft. In such surroundings, since sheets can be separated from each other due to their own weight, there has been almost no risk of feeding a plurality of sheets at time, conventionally. The inventor observed in the test, when the paper has decreased to one sheet, whether or not jamming might occur because of damage to the bottom face of the sheet or wrinkle in the sheet. The embodiment also brought the favorable result in that jamming did not occur and no damage was observed in the reverse sides of the sheets.

As explained in detail, the color printer 1 of this embodiment is provided with the first friction member 31 adhered to a position in the upper surface of the push-up board 24 which receives pressing force of the pick roller 22 and the second friction member 32 adhered to the backward position in the sheet transferring direction. The dynamic friction coefficient $\mu$1 of the first friction member 31 is approximately equivalent to the dynamic friction coefficient between sheets. The dynamic friction coefficient $\mu$2 of the second friction member 32 is larger than the dynamic friction coefficient $\mu$1 of the first friction member 31 and smaller than the dynamic friction coefficient $\mu$3 of the pick roller 22. Thus, a large number of sheets produces larger friction force in between the lowermost sheet and the second friction member 32 by own weight of the sheets than in between the sheets. Accordingly, double-paper feeding is prevented whichever types of sheets are used. On the other hand, when the loaded sheets are decreasing to very little in number, the friction force produced by own weight of the sheets becomes small between the lowermost sheet and the second friction member 32 and thereby even the last few sheets can be securely fed. Further, even a push-up board 24 which has a slippery surface with a smaller dynamic friction coefficient can feed sheets securely.

In the present invention, preferably, the push-up board has a convex part located upstream of the first friction member in a sheet transferring direction and made convex toward the sheet bundle, and the second friction member is attached to the convex part. This allows a most protruding part of the second friction member protruding to the sheet bundle side to protrude more than a sheet bundle side surface of the first friction member.

In the present invention, preferably, the second friction member is arranged such that a downstream-side edge in the sheet transferring direction is located within 10.0 mm or a radius of the pick roller in the sheet transferring direction from the closest position between the pick roller and the first friction member. According to this arrangement, the second friction member will not be located far apart from the pick roller so that the lowermost sheet in a sheet bundle with a certain level of thickness can be brought into contact with the second friction member surely when the pick roller comes to contact with the uppermost sheet.

In the present invention, preferably, the downstream-side edge of the second friction member in the sheet transferring direction forms a bump with a height of 1.5 mm or lower with reference to the sheet bundle side surface of the first friction member. This allows the second friction member to be brought into contact with a sheet bundle surely and prevents a scratch in the sheet bundle.

Further in the present invention, preferably, a film member with a thickness of 0.15 mm or thinner is adhered across an upstream-side edge of the second friction member in the sheet transferring direction and the push-up board. This prevents a sheet bundle from being stuck at the edge of the second friction member in placing the sheet bundle on the push-up board.

Additionally, in the present invention, the dynamic friction coefficient of a part of the sheet bundle side surface of the push-up board which is not covered with the first friction member or the second friction member to sheets may be within 0.16. Dynamic friction coefficients of plate materials such as steel plates have wide variations depending on their manufactures. According to the invention, sheets can be surely transferred even when a push-up board with a small dynamic friction coefficient as above is used.

The present invention is not restricted to the above-described embodiment, but needless to say, may be improved or modified in various ways within a scope not departing from the present invention.

For instance, the slit 33 is formed for attaching the first friction member 31 in the embodiment and a bevel part is also provided at the back side of the slit 33 so as to adhere the second friction member 32. When the slit 33 is not formed or the bevel part at the back side of the slit 33 is not provided, the upper surface of the second friction member 32 may be adjusted so as to be higher than the upper surface of the first friction member 31 by utilizing own thickness of the second friction member 32, other member for adjusting thickness and the like. Incidentally, the aforementioned material and size of the first friction member 31 and the second friction member 32 is merely an example of the embodiment. So far as the members have appropriate dynamic friction coefficients to sheets and strength, material or size of the members can be changed.

Also, the aforementioned shape of the sheet feeding cassette 21 and the push-up board 24 is an example of the embodiment, which does not make restriction. Further, the invention can be applied not only to color printers, but also to other image forming apparatus such as black and white printers, copiers, and facsimiles, which has an image forming device.

What is claimed is:

1. A sheet feeding device comprising a pick roller to be brought into contact with an uppermost sheet in a sheet bundle for drawing out the uppermost sheet and a push-up board for pushing up the sheet bundle to the pick roller, wherein the sheet feeding device further comprises:

a first friction member located in a position at push-up board side opposed to the pick roller with the sheet bundle interposed therebetween so as to be brought into contact with a lowermost sheet in the sheet bundle; and a second friction member located in a position at push-up board side upstream in a sheet transferring direction and not opposed to the pick roller so as to be brought into contact with the lowermost sheet in the sheet bundle, and wherein the second friction member has a most protruding part which protrudes to the sheet bundle more than a sheet bundle side surface of the first friction member and a sheet bundle side surface of the second friction member is concave toward the sheet bundle, and a dynamic friction coefficient of the second friction member to the sheet is larger than a dynamic friction coefficient of the first friction member to the sheet and smaller than a dynamic friction coefficient of the pick roller to the sheet.

2. The sheet feeding device according to claim 1, wherein the push-up board has a convex part located upstream of the first friction member in a sheet transferring direction and made convex toward the sheet bundle;

a portion of the second friction member is attached to the convex part;

a downstream-side edge of the second friction member in the sheet transferring direction is located within a radius of the pick roller in the sheet transferring direction from a closest position between the pick roller and the first friction member; and the downstream-side edge of the second friction member in the sheet transferring direction forms a bump with a height not exceeding 1.5 mm with reference to the sheet bundle side surface of the first friction member.

3. The sheet feeding device according to claim 2, wherein the sheet bundle side surface of the first friction member is substantially coplanar or below an uppermost portion of the convex part of the push-up board.

4. The sheet feeding device according to claim 1, wherein a part of a sheet bundle side surface of the push-up board which is covered with neither the first friction member nor the second friction member possesses a dynamic friction coefficient not exceeding 0.16 to the sheet.

5. A sheet feeding cassette to be used for an image forming apparatus which has a pick roller, the sheet feeding cassette comprising a push-up board for pushing up a sheet bundle to the pick roller, wherein the sheet feeding cassette further comprises:

a first friction member located in a position at push-up board side opposed to the pick roller with the sheet bundle interposed therebetween so as to be brought into contact with a lowermost sheet in the sheet bundle; and a second friction member located in a position at push-up board side upstream in a sheet transferring direction and not opposed to the pick roller so as to be brought into contact with the lowermost sheet in the sheet bundle, and wherein the second friction member has a most protruding part which protrudes to the sheet bundle more than a sheet bundle side surface of the first friction member and a sheet bundle side surface of the second friction member is concave toward the sheet bundle, and a dynamic friction coefficient of the second friction member to the sheet is larger than a dynamic friction coefficient of the first friction member to the sheet and smaller than a dynamic friction coefficient of the pick roller to the sheet.

6. The sheet feeding cassette according to claim 5, wherein the push-up board has a convex part located upstream of the first friction member in a sheet transferring direction and made convex toward the sheet bundle;

a portion of the second friction member is attached to the convex part;

a downstream-side edge of the second friction member in the sheet transferring direction is located within a radius of the pick roller in the sheet transferring direction from a closest position between the pick roller and the first friction member; and the downstream-side edge of the second friction member in the sheet transferring direction forms a bump with a height not exceeding 1.5 mm with reference to the sheet bundle side surface of the first friction member.

7. The sheet feeding cassette according to claim 6, wherein the sheet bundle side surface of the first friction member is substantially coplanar or below an uppermost portion of the convex part of the push-up board.

8. The sheet feeding cassette according to claim 5, wherein a part of a sheet bundle side surface of the push-up board which is covered with neither the first friction member nor the second friction member possesses a dynamic friction coefficient not exceeding 0.16 to the sheet.

9. An image forming apparatus comprising an image forming part, a pick roller to be brought into contact with an uppermost sheet in a sheet bundle for drawing out the uppermost sheet to the image forming part, and a push-up board for pushing up the sheet bundle to the pick roller, wherein the image forming apparatus further comprises:

a first friction member located in a position at push-up board side opposed to the pick roller with the sheet bundle interposed therebetween so as to be brought into contact with a lowermost sheet in the sheet bundle; and a second friction member located in a position at push-up board side upstream in a sheet transferring direction and not opposed to the pick roller so as to be brought into contact with the lowermost sheet in the sheet bundle, and wherein the second friction member has a most protruding part which protrudes to the sheet bundle more than a sheet bundle side surface of the first friction member and a sheet bundle side surface of the second friction member is concave toward the sheet bundle, and a dynamic friction coefficient of the second friction member to the sheet is larger than a dynamic friction coefficient of the first friction member to the sheet and smaller than a dynamic friction coefficient of the pick roller to the sheet.

10. The image forming apparatus according to claim 9, wherein the push-up board has a convex part located upstream of the first friction member in a sheet transferring direction and made convex toward the sheet bundle;

a portion of the second friction member is attached to the convex part;

a downstream-side edge of the second friction member in the sheet transferring direction is located within a radius of the pick roller in the sheet transferring direction from a closest position between the pick roller and the first friction member; and the downstream-side edge of the second friction member in the sheet transferring direction forms a bump with a height not exceeding 1.5 mm with reference to the sheet bundle side surface of the first friction member.

11. The image forming apparatus according to claim 10, wherein the sheet bundle side surface of the first friction member is substantially coplanar or below an uppermost portion of the convex part of the push-up board.

12. The image forming apparatus according to claim 9, wherein a part of a sheet bundle side surface of the push-up board which is covered with neither the first friction member nor the second friction member possesses a dynamic friction coefficient not exceeding 0.16 to the sheet.

13. A sheet feeding device comprising a pick roller to be brought into contact with an uppermost sheet in a sheet bundle for drawing out the uppermost sheet and a push-up board for pushing up the sheet bundle to the pick roller, wherein the sheet feeding device further comprises:

a first friction member located in a position at push-up board side opposed to the pick roller with the sheet bundle interposed therebetween so as to be brought into contact with a lowermost sheet in the sheet bundle; and a second friction member located in a position at push-up board side upstream in a sheet transferring direction and not opposed to the pick roller so as to be brought into contact with the lowermost sheet in the sheet bundle, and wherein the second friction member has a most protruding part which protrudes to the sheet bundle more than a sheet bundle side surface of the first friction member, a dynamic friction coefficient of the second friction member to the sheet is larger than a dynamic friction coefficient of the first friction member to the sheet and smaller than a dynamic friction coefficient of the pick roller to the sheet, and wherein a film member with a thickness not exceeding 0.15 mm is adhered across an upstream-side edge of the second friction member in the sheet transferring direction and the push-up board.

14. A sheet feeding cassette to be used for an image forming apparatus which has a pick roller, the sheet feeding cassette comprising a push-up board for pushing up a sheet bundle to the pick roller, wherein the sheet feeding cassette further comprises:

a first friction member located in a position at push-up board side opposed to the pick roller with the sheet bundle interposed therebetween so as to be brought into contact with a lowermost sheet in the sheet bundle; and a second friction member located in a position at push-up board side upstream in a sheet transferring direction and not opposed to the pick roller so as to be brought into contact with the lowermost sheet in the sheet bundle, and wherein the second friction member has a most protruding part which protrudes to the sheet bundle more than a sheet bundle side surface of the first friction member, a dynamic friction coefficient of the second friction member to the sheet is larger than a dynamic friction coefficient of the first friction member to the sheet and smaller than a dynamic friction coefficient of the pick roller to the sheet, and wherein a film member with a thickness not exceeding 0.15 mm is adhered across an upstream-side edge of the second friction member in the sheet transferring direction and the push-up board.

15. An image forming apparatus comprising an image forming part, a pick roller to be brought into contact with an uppermost sheet in a sheet bundle for drawing out the uppermost sheet to the image forming part and a push-up board for pushing up the sheet bundle to the pick roller, wherein the image forming apparatus further comprises:

a first friction member located in a position at push-up board side opposed to the pick roller with the sheet bundle interposed therebetween so as to be brought into contact with a lowermost sheet in the sheet bundle; and a second friction member located in a position at push-up board side upstream in a sheet transferring direction and not opposed to the pick roller so as to be brought into contact with the lowermost sheet in the sheet bundle, wherein the second friction member has a most protruding part which protrudes to the sheet bundle more than a sheet bundle side surface of the first friction member, a dynamic friction coefficient of the second friction member to the sheet is larger than a dynamic friction coefficient of the first friction member to the sheet and smaller than a dynamic friction coefficient of the pick roller to the sheet, and wherein a film member with a thickness not exceeding 0.15 mm is adhered across an upstream-side edge of the second friction member in the sheet transferring direction and the push-up board.

* * * * *